US007361236B2

(12) United States Patent
Kondo et al.

(10) Patent No.: US 7,361,236 B2
(45) Date of Patent: Apr. 22, 2008

(54) MARTENSITIC STAINLESS STEEL

(75) Inventors: Kunio Kondo, Sanda (JP); Takahiro Kushida, Amagasaki (JP); Yuichi Komizo, Nishinomiya (JP); Masaaki Igarashi, Sanda (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 10/411,186

(22) Filed: Apr. 11, 2003

(65) Prior Publication Data

US 2005/0274436 A1 Dec. 15, 2005

Related U.S. Application Data

(63) Continuation of application No. PCT/JP02/05399, filed on May 31, 2002.

(30) Foreign Application Priority Data

Jun. 1, 2001 (JP) ..... 2001-167046

(51) Int. Cl.

| | |
|---|---|
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl. ..... 148/326; 148/325; 148/327

(58) Field of Classification Search ..... 148/325–327; 420/34, 52–54, 49, 67–70

See application file for complete search history.

(56) References Cited

U.S. PATENT DOCUMENTS 5,383,983 A 1/1995 Kondo et al.

5,652,394 A * 7/1997 Sugino et al. ..... 73/779

(Continued)

FOREIGN PATENT DOCUMENTS

AR 004936 4/1999

(Continued)

OTHER PUBLICATIONS

English translation of Japanese patent 60-149715, Yoshitaka Iwabuchi et al., Aug. 7, 1985.*

*Primary Examiner*—Deborah Yee
(74) *Attorney, Agent, or Firm*—Clark & Brody

(57) ABSTRACT

A martensitic stainless steel having a C content of 0.01 to 0.1 mass %, a Cr content of 9 to 15 mass % and a N content of not more than 0.1 mass %, wherein the maximum length of the carbides in the steel is 10 to 200 nm in the direction of the minor axis, or wherein the ratio of the average Cr concentration [Cr] to the average Fe concentration [Fe] in carbides in the steel ([Cr]/[Fe]) is not more than 0.4, or wherein the content of $M_{23}C_6$ type carbides is not more than 1 volume %, the content of $M_3C$ type carbides is 0.01 to 1.5 volume % and the content of MN type or $M_2N$ type nitrides is not more than 0.3 volume % is provided. This stainless steel has a high toughness in spite of both a relatively more C content and a high strength, thereby providing a, wide applicability to pipe material for oil wells containing carbon dioxide and a small amount of hydrogen sulfide, in particular for oil wells having a much greater depth.

12 Claims, 2 Drawing Sheets

U.S. PATENT DOCUMENTS

| | | | | |
|---|---|---|---|---|
| 6,277,216 | B1 * | 8/2001 | Leap et al. | 148/335 |
| 6,673,165 | B2 * | 1/2004 | Koga et al. | 148/325 |
| 6,793,744 | B1 * | 9/2004 | Jung | 148/325 |

FOREIGN PATENT DOCUMENTS

| | | | | |
|---|---|---|---|---|
| EP | 0178334 | | | 4/1986 |
| EP | 0732418 | A1 | | 9/1996 |
| EP | 1026273 | A1 | | 8/2000 |
| JP | 60-149715 | | * | 8/1985 |
| JP | 05-098347 | | | 4/1993 |
| JP | 05-287455 | | | 11/1993 |
| JP | 408067950 | | * | 3/1996 |
| JP | 10-17999 | | * | 1/1998 |
| JP | 2000-178692 | | | 6/2000 |
| JP | 2000204434 | | * | 7/2000 |
| JP | 2001-032047 | | | 2/2001 |
| JP | 2001-152296 | | * | 5/2001 |
| JP | 2001123254 | | | 5/2001 |
| JP | 2001152296 | | | 6/2001 |

* cited by examiner

MARTENSITIC STAINLESS STEEL

This application is a continuation of International Patent Application No. PCT/JP02105399. This PCT application was not in English as published under PCT Article 21(2).

TECHNICAL FIELD

The present invention relates to a martensitic stainless steel having a high strength and excellent properties regarding corrosion resistance and toughness, which stainless steel is suited to use as a well pipe or the, like for oil wells or gas wells hereinafter these are generally referred to as "oil well"), in particular for oil wells having a much greater depth, which contain carbon dioxide and a small amount of hydrogen sulfide.

BACKGROUND ART

A 13% Cr martensitic stainless steel is frequently used in an oil well environment containing carbon dioxide and a small amount of hydrogen sulfide. More specifically, an API—13% Cr steel (13% Cr—0.2% C), which is specified by API (American Petroleum Institute), is widely used since it has an excellent corrosion resistance against carbon dioxide (% used herein means mass % unless a special usage). However, it is noted that the API—13% Cr steel has a relatively small toughness. Although it can generally be used for an oil well steel pipe which normally requires a yield stress of 552 to 655 MPa (80 to 95 ksi), there is a problem that a reduced toughness prevents the steel pipe from being used in an oil well having a much greater depth, since it requires a high yield stress of not less than 759 MPa (110 ksi).

In recent years, modified type 13% Cr steel has been developed in order to improve the corrosion resistance, in which case, an extremely small amount of C content is used and Ni is added instead of the reduced carbon content. This modified type 13% Cr steel can be used in much severer corrosion environments under a condition of requiring a high strength, since a sufficiently high toughness can be obtained. However, such a reduction in the C content tends to precipitate δ ferrites which cause the hot workability, corrosion resistance, toughness and the like to deteriorate. In order to suppress the generation of ferrites, it is necessary to appropriately include expensive Ni in accordance with the added amount of Cr, Mo and other, thereby providing a great increase in the production cost.

Several attempts have been proposed to improve the strength and toughness in both API—13% Cr steel and modified 13% Cr steel. For instance, in Japanese Patent Application Laid-open No. H08-120415, it is shown that an attempt has been made to improve the strength and toughness using effective N which cannot be stabilized by Al on the basis of API—13% Cr steel. In this prior art, however, it follows from the description of the embodiments that steel having a yield stress of order of 552 to 655 MPa (80 to 95 ksi) provides a fracture appearance transition temperature of −20 to −30° C., at most in the Charpy impact test, thereby making it impossible to ensure a sufficient toughness at such a high strength as 759 MPa (110 ksi).

In Japanese Patent Applications Laid-open No. 2000-144337, No. 2000-226614, No. 2001-26820 and No. 2001-32047, a technique for ensuring a high strength and a high toughness in improved 13% Cr steel having low carbon content is respectively described, wherein such a high strength and such a high toughness can be obtained by controlling the precipitation of carbides in grain boundaries and by precipitating residual austenite, along with the effective usage of fine V precipitates. For this purpose, it is necessary to add a corresponding amount of Ni or V, which is very expensive, and further to control the temper condition to a very restricted extent, thereby again providing a great increase in the manufacturing cost, compared with those of API—13% Cr steel.

DISCLOSURE OF INVENTION

It is an object of the present invention to provide a martensitic stainless steel having a high strength together with excellent properties regarding the corrosion resistance and toughness by means of clarifying and analyzing systematically the factors controlling toughness.

To attain the above object, the present inventors investigated the factors controlling the toughness in martensitic stainless steels and then found that the toughness could be greatly improved by controlling the structure and chemical composition of precipitated carbides without any application of the prior art method either of precipitating residual austenite by carrying out a high temperature tempering for a high Ni content steel or of dispersing the carbides inside grains due to the preferable precipitation of VC.

Firstly, the present inventors investigated the reason why the API—13% Cr steel exhibited such a low toughness. In the course of investigation, using 11% Cr—2% Ni—Fe steel which provided no generation of δ ferrites and single phase of martensite even if the C content was varied, three-type steel specimens each having a carbon content of 0.20%, 0.11% or 0.008% were prepared, and then the microstructure and the toughness after the tempering in the case of the tempering temperature being varied are inspected for each steel specimen.

The results are shown in FIG. 1, where the abscissa indicates the tempering temperature (° C.) and the coordinate indicates the fracture appearance transition temperature vTrs (° C.). As can be seen, a reduction in the amount of the carbon content provides an improvement in the toughness.

FIG. 2 shows as an example of an electron micrograph of replica extracted from a steel containing an amount of 0.20% C content which is approximately identical with that in API—13% Cr steel. As can be recognized from this photograph, the conventional treatment of tempering generates a greater amount of carbides, which are not of $M_3C$ type, but of $M_{23}C_6$ type and mostly coarse in size (M represents a metal element). The metal elements in the carbide of $M_{23}C_6$ type are mostly Cr, and a few remaining elements are Fe. However, there are few carbides in the steel having a carbon content of 0.008%.

Accordingly, it can be recognized that the reduced toughness of API—13% Cr steel is due to the existence of a number of $M_{23}C_6$ type carbides precipitated. Hence, an extremely reduced carbon content is required in order to obtain a high toughness and to prevent $M_{23}C_6$ type carbides from being precipitated. If, however, the carbon content decreases, a high strength can hardly be obtained and, at the same time, the addition of Ni is required in order to maintain the single phase of martensite, thereby causing an increase in the production cost.

From this viewpoint, the present inventors researched steels having both a metallurgical structure including no precipitation of $M_{23}C_6$ type carbides and a sufficiently high toughness without reduction of the carbon content. As a result, the present inventors found that the steel with a microstructure having fine precipitation of $M_3C$ type carbides whose size is relatively smaller compared with $M_{23}C_6$ type carbides, shows better toughness than that with a microstructure having suppressed precipitation of $M_{23}C_6$ type carbides so that carbon is super-saturated.

FIG. 3 shows as an example of an electron micrograph of replica extracted from steels in which $M_3C$ type carbides are finely dispersed in precipitation by air-cooling after the solution treatment. In this case, the basic composition comprises 0.06% C—11% Cr—2% Ni—Fe.

FIG. 4 is a diagram showing the toughness in two cases of carbide precipitation for steel having a basic composition of 11% Cr—2% Ni—Fe. In one case $M_3C$ type carbides being finely dispersed and in the other case no carbides being precipitated, where the abscissa indicates the carbon content (mass %) and the ordinate indicates the fracture appearance transition temperature vTrs (° C.). Two different steels were prepared as follows: The first includes $M_3C$ type carbides finely dispersed in precipitation and was prepared by air-cooling (cooling at room temperature) after the solution treatment, whereas the second includes no carbides and was prepared by rapid cooling (water-cooling) after the solution treatment.

As can be seen in this diagram, a great difference can be found in the toughness at each specified amount of the carbon content between the first and second steels, and the toughness is more desirable in the first steel with the fine dispersion of precipitated $M_3C$ type carbides (mark ■ in the diagram) than in the second steel without precipitation of carbides (mark □ in the diagram).

In addition, it is found that there are no δ ferrites either in the first steel or in the second steel and therefore the carbides influence on the toughness in the martensite is clarified.

Moreover, a study for the component of the carbides revealed that M in an $M_{23}C_6$ type carbide was mainly Cr whereas M in an $M_3C$ type carbide was mainly Fe, so that corrosion resistance is not reduced at all even when the carbides are precipitated, so long as they are of $M_3C$ type.

On the basis of the above findings, a further detailed study was made as for the influence of the carbides on the toughness in martensitic stainless steels. As a result, it has been recognized that the toughness can be improved so long as the metallurgical structure satisfies the following conditions:

The carbides precipitated inside grains do not provide a marked reduction in the toughness.

It is noted that the toughness is also influenced by the size of the carbide, that is, an increase in the size reduces the toughness. However, finely dispersed carbides provide an increase in the toughness, compared with that in the state in which there is no carbide. More specifically, the toughness is greatly improved in the steel even when the maximum length of the carbides is 10 nm to 200 nm in the direction of the minor axis.

Moreover, the toughness is influenced by the composition of the carbides. In fact, a too high value of an average Cr concentration [Cr] reduces the toughness. On the other hand, the toughness is greatly improved when the ratio of the average Cr concentration of the carbide [Cr] to the average Fe concentration of that [Fe] in the steel ([Cr]/[Fe]) is not more than 0.4 in spite of carbide type.

Moreover, the toughness is influenced by the quantity of $M_{23}C_6$ type carbides, the quantity of $M_3C$ type carbides and the quantity of MN type or $M_2N$ type nitrides. An inadequate selection of the quantities of these type carbides and nitrides results in a decreased toughness. More specifically, if a quantity of $M_{23}C_6$ type carbides is not more than 1 volume %; a quantity of $M_3C$ type carbides is 0.01 to 1.5 volume %; and a quantity of MN type or $M_2N$ type nitrides is not more than 0.3 volume %, the toughness is greatly improved.

In accordance with the present invention, the following martensitic stainless steels (1) to (3) are realized based on the above knowledge:

(1) A martensitic stainless steel including C: 0.01 to 0.1%, Cr: 9 to 15%, and N: not more than 0.1% in mass, wherein the maximum length of the carbides in the steel is 10 to 200 nm in the direction of the minor axis.

(2) A martensitic stainless steel including C: 0.01 to 0.1%, Cr: 9 to 15%, and N: not more than 0.1% in mass, wherein the ratio of the average Cr concentration of the carbide in the steel [Cr] to the average Fe concentration of that [Fe] in the steel [Cr]/[Fe])is not more than 0.4.

(3) A martensitic stainless steel including C: 0.01 to 0.1%, Cr: 9 to 15%, and N: not more than 0.1% in mass, wherein the quantity of $M_{23}C_6$ type carbides in the steel is not more than 1 volume %, the quantity of $M_3C$ type carbides is 0.01 to 1.5 volume % and the quantity of MN type or $M_2N$ type nitrides is not more than 0.3 volume % in the steel.

It is preferable that, aside from the above-specified quantities of C, Cr and N, the above-mentioned martensitic stainless steels (1) to (3) include Si: 0.05 to 1%, Mn: 0.05 to 1.5%, P: not more than 0.03%, S: not more than 0.01%, Ni: 0.1 to 7.0%, Al: 0.0005 to 0.05% in mass, and the residual comprises Fe and impurities.

Moreover, the elements in not less than one of the following groups A, B and C can be included in the martensitic stainless steels according to the present invention:

Group A: not less than one of Mo: 0.05 to 5% and Cu: 0.05 to 3%.

Group B: not less than one of Ti: 0.005 to 0.5%, V: 0.005 to 0.5% and Nb: 0.005 to 0.5%.

Group C: not less than one of B: 0.0002 to 0.005%, Ca: 0.0003 to 0.005%, Mg: 0.0003 to 0.005% and rare-earth elements: 0.0003 to 0.005%.

BEST MODE FOR CARRYING OUT THE INVENTION

Figure 1:
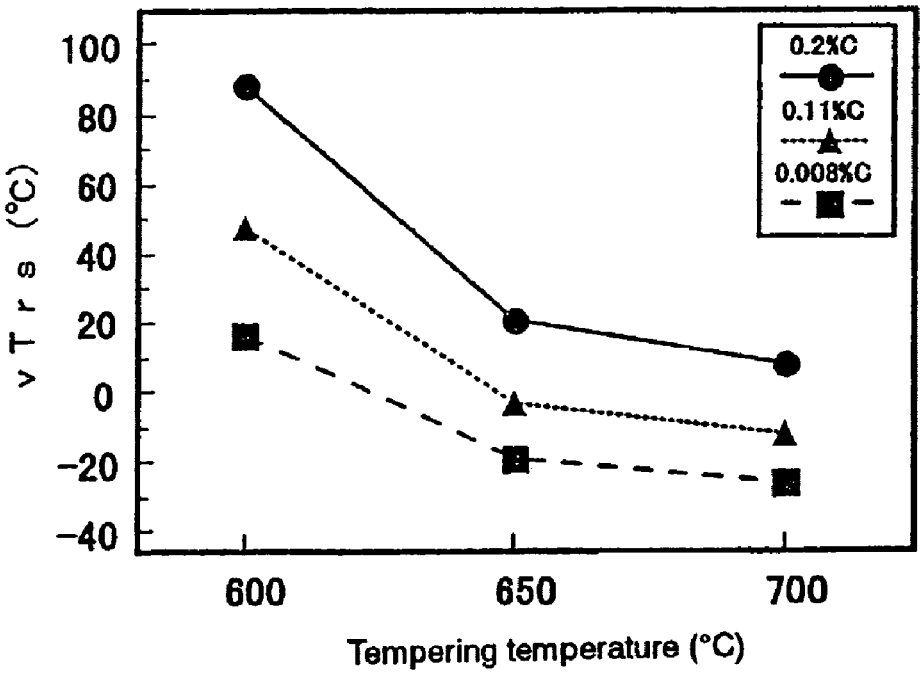
FIG. 1 is a diagram showing the relationship between the tempering temperature and the fracture appearance transition temperature vTrs in steel having a basic composition of 11% Cr—2% Ni—Fe steel varying carbon contents of 0.20%, 0.11% and 0.008%.
Figure 2:
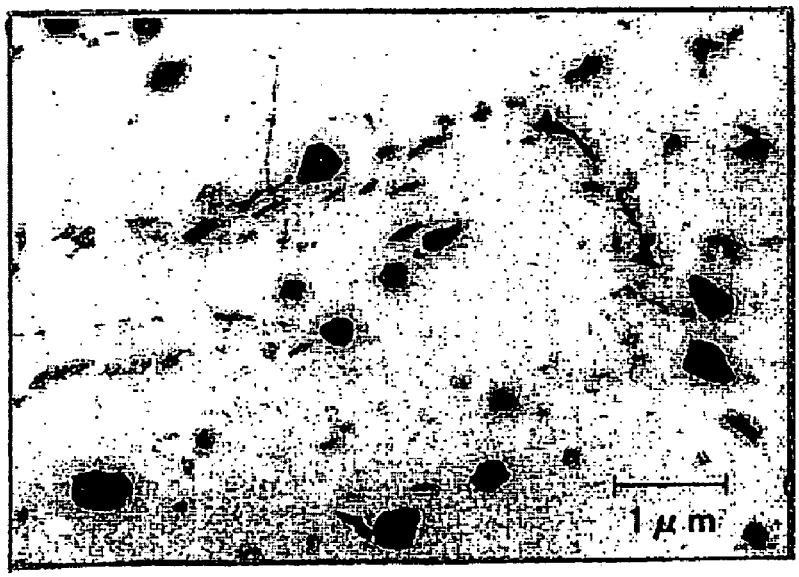
FIG. 2 is an example of an electron micrograph for an extraction replica of a steel having a basic composition of 0.20% C—11% Cr—2% Ni—Fe in which coarse $M_{23}C_6$ type carbides are precipitated.
Figure 3:
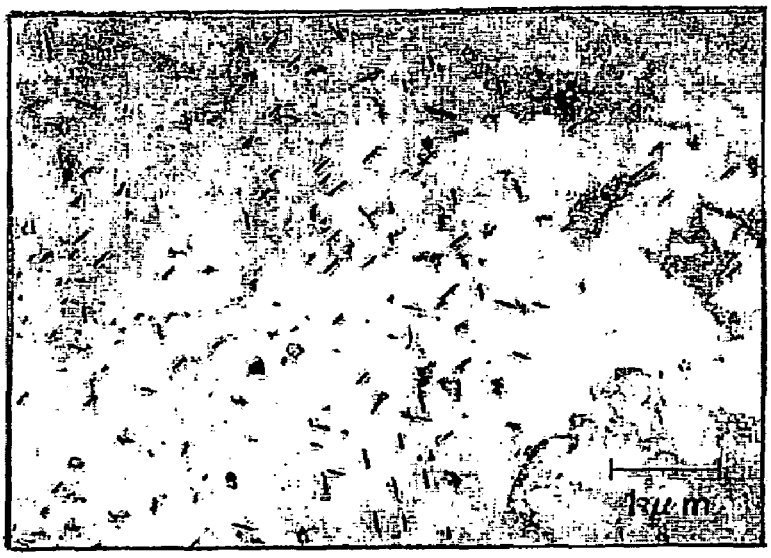
FIG. 3 is an example of an electron micrograph for an extraction replica of a steel having a basic composition of 0.06% C—11% Cr—2% Ni—Fe in which fine $M_3C$ type carbides are precipitated.
Figure 4:
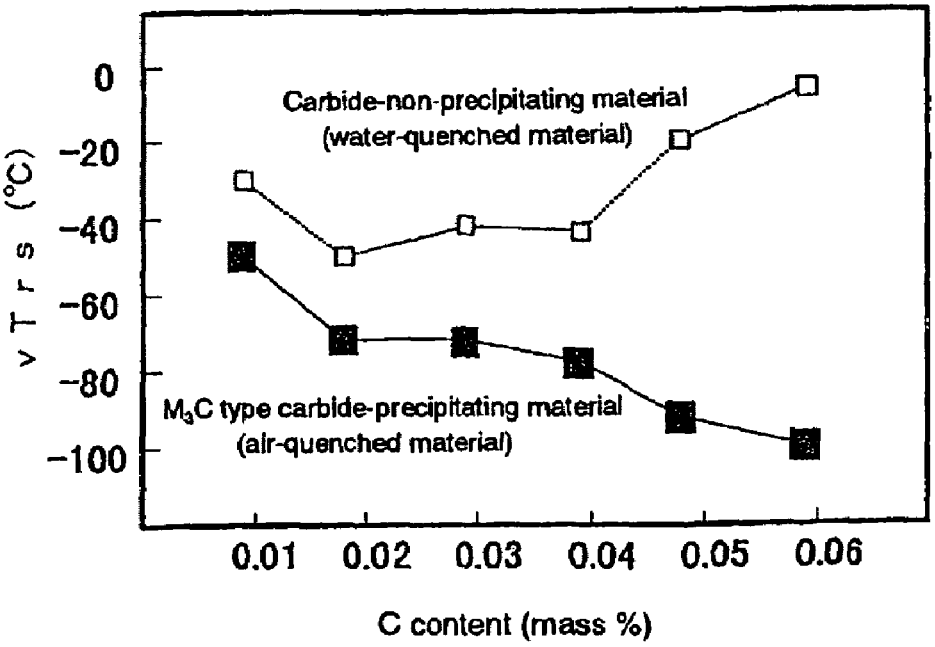
FIG. 4 is a diagram showing the relationship between the carbon content and the fracture appearance transition temperature vtrs in the cases of finely precipitated $M_3C$ type carbides and of no precipitated carbides.

In the following, the martensitic stainless steel according to the present invention will be described in detail as for the reason why the chemical composition and metallurgical structure are specified as above. Hereinafter, "%" means "mass %" unless specified.

1. Chemical Composition

C: 0.01 to 0.1%

Carbon acts as an austenite-forming element, and therefore C should be included in a concentration of not less than 0.01%, since the concentration of Ni, which also acts as another element of forming austenite, can be reduced by adding C into steel. However, a carbon content of more than 0.1% reduces the corrosion resistance under a corrosion environment containing $CO_2$ or the like. Accordingly, the carbon content is set to be 0.01 to 0.1%. In this case, it is preferable that the carbon content should be set not less than 0.02% in order to reduce the Ni content, it ranges preferably from 0.02 to 0.08%, and more preferably from 0.03 to 0.08%.

Cr: 9 to 15%

Cr is a basic element for the martensitic stainless steel according to the present invention. Cr is a very important element for ensuring the corrosion resistance, the stress corrosion cracking resistance and the like under a very severe corrosion environment containing $CO_2$, Cl—, $H_2S$ and the like. Moreover, an appropriate Cr concentration provides a stable metallurgical structure in the martensite. In order to obtain the above effects, Cr has to be included in a concentration of not less than 9%. However, a Cr concentration of more than 15% causes ferrites to be generated in the microstructure of the steel, thereby making it difficult to obtain microstructure, when the hardening treatment is carried out. As a result, the Cr content should be set to be 9 to 15%. It ranges preferably from 10 to 14%, and more preferably from 11 to 13%.

N: Not More Than 0.1%

N is an austenite-forming element and serves as an element for reducing the Ni content in the same way as C. However, an N content of more than 0.1% reduces the toughness. As a result, the N content should be set to be not more than 0.1%. It should be preferably not more than 0.08%, and more preferably not more than 0.05%.

2. Microstructure

In the martensitic stainless steel according to the present invention, it is necessary to satisfy the following condition (a) or condition (b) or condition (c), as described above:

Condition (a): The maximum length of carbides dispersed inside grains is 10 to 200 nm in the direction of the minor axis.

Condition (b): The ratio of the average Cr concentration [Cr] to the average Fe concentration [Fe] in carbides in the steel ([Cr]/[Fe]) is not more than 0.4.

Condition (c): The quantity of $M_{23}C_6$ type carbides in the steel is not more than 1 volume %, the quantity of $M_3C$ type carbides in the steel is 0.01 to 1.5 volume % and the quantity of MN type or $M_2N$ type nitrides in the steel is not more than 0.3 volume %.

Coarse carbides reduce the toughness of the steel. However, finely dispersed carbides having the maximum length of not less than 10 nm in the direction of the minor axis rather increases the toughness, compared with that in the state in which no carbides exist in grains. On the other hand, carbides having the maximum length of more than 200 nm in the direction of the minor axis provide no improvement in the toughness. In the present invention, therefore, it is preferable that the maximum length of the carbides in the steel is 10 to 200 nm in the direction of the minor axis. The upper limit of the maximum length should be set to be preferably 100 nm, and more preferably 80 nm.

When the ratio of the average Cr concentration [Cr] to the average Fe concentration [Fe] in carbides in the steel ([Cr]/[Fe]) exceeds 0.4, the toughness no longer increases and the corrosion resistance decreases. In the present invention, therefore, it is preferable that the ratio of the average Cr concentration [Cr] to the average Fe concentration [Fe] in carbides in the steel ([Cr]/[Fe]) is not more than 0.4. The ratio should be set to be preferably not more than 0.3, and more preferably not more than 0.15. In this case, a smaller magnitude of the above concentration ratio ([Cr]/[Fe]) is correspondingly more preferable, so that no lower limit is given.

When $M_{23}C_6$ type carbides, $M_3C$ type carbides and MN type or $M_2N$ type nitrides in the steel are included respectively at concentrations of more than 1 volume %, less than 0.01 volume % or more than 1.5 volume %, and more than 0.3 volume % in a steel, no toughness increases. In the present invention, therefore, it is preferable that the quantities of the $M_{23}C_6$ type carbides, $M_3C$ type carbides, and MN type or $M_2N$ type nitrides in the steel are not more than 1 volume %, 0.01 to 1.5 volume % and not more than 0.3 volume %, respectively.

In accordance with the invention, the upper limit of the content of $M_{23}C_6$ type carbides should be preferably 0.5 volume %, and more preferably 0.1 volume %, the range of the content of $M_3C$ type carbides should be preferably 0.01 to 1 volume %, and more preferably 0.01 to 0.5 volume %, and the upper limit of the content of MN type or $M_2N$ type nitrides should be preferably 0.2 volume % and more preferably 0.1 volume %. In this case, smaller amounts of both $M_{23}C_6$ type carbides and MN type or $M_2N$ type nitrides correspondingly provide better results. Hence, no lower limit can be given for the amount of both the $M_{23}C_6$ type carbides and the MN type or $M_2N$ type nitrides.

The maximum length of a carbide particle in the direction of the minor axis under the condition a means the magnitude determined from the following procedures: An extraction replica specimen was prepared, and an electron micrograph was taken at a magnification of 10,000 for each of randomly selected ten fields having a specimen area of 5 μm×7 μm. The minor and major axes of respective carbides in each micrograph were measured by using the image analysis, and then the maximum length was determined from the longest length in the direction of the minor axis among the carbides in all the fields.

Further, the ratio of the average Cr concentration [Cr] to the average Fe concentration [Fe] in carbides in the steel ([Cr]/[Fe]) under the condition b means the ratio of Cr and Fe contents (at mass %), which are determined by chemical analysis of the extraction residual.

Furthermore, the quantities (volume rates) of $M_{23}C_6$ type carbides, $M_3C$ type carbides and MN type or $M_2N$ type nitrides in the steel under the condition c mean the magnitudes determined from the following procedures: An extraction replica specimen was prepared, and an electron micrograph was taken at a magnification of 10,000 for each of randomly selected ten fields having a specimen area of 5 μm×7 μm. By using the electron diffraction method or the EDS element analysis method, each carbide particle in respective fields was identified as to whether it belongs to $M_{23}C_6$ type carbide or to $M_3C$ type carbide and to MN type or $M_2N$ type nitride. Thereafter, the area rates of the respective carbides and nitride for ten fields were determined, using the image analysis and then averaged to obtain the quantities.

Regarding the heat treatments for obtaining the microstructure satisfying the above condition a or the condition b or the condition c, there is no special restriction, so long as the heat treatments provide a microstructure corresponding to any of the above-mentioned conditions. However, the tempering at a high temperature, more specifically the tempering at a temperature of more than 500° C., which is conventionally employed in the heat treatments for the martensitic stainless steels, should not be carried out in the present invention. This is because the tempering at a temperature of more than 500° C. provides a greater number of $M_{23}C_6$ type carbides for the intented martensitic stainless steel in the present invention including such a great amount of Cr and C.

The microstructure corresponding to any of the above conditions can readily be obtained by appropriately adjusting the conditions of quenching or tempering in the production in accordance with the chemical composition of the steel (e.g. the conditions shown in the embodiments hereinafter described). For instance, heat treatments for obtaining a finely dispersed precipitation of $M_3C$ type carbides are exemplified as follows:

After hot working, a martensitic stainless steel having predetermined contents of C, Cr and N, specified by the present invention, is either quenched (water-cooling) and then tempered at 300 to 450° C., or cooled in air (cooling at room temperature). Alternately, the steel is heated up to the transformation temperature $A_{c3}$ to form austenite phase (solid solution treatment), and then the steel is either cooled in air (cooling at room temperature) or quenched and tempered at a low temperature of 300 to 450° C.

The martensitic stainless steel according to the present invention provides an excellent property regarding the toughness, so long as the above-described chemical composition and the microstructure are satisfied. It is desirable that, regarding the chemical composition, the contents of Si, Mn, P, S, Ni and Al are within the respective ranges described in the following, and the residual substantially comprises Fe.

Si: 0.05 to 1%

Si serves as an element effective for deoxidizing. However, a Si content of less than 0.05% provides a greater loss of Al in the process of deoxidizing, whereas a Si content of more than 1% provides a decreased toughness for the steel. Accordingly, it is desirable that the Si content is set to be 0.05 to 1%. The range of the content should be preferably 0.1 to 0.5%, and more preferably 0.1 to 0.35%.

Mn: 0.05 to 1.5%

Mn serves as an element effective for enhancing the strength of the steel, and further is an austenite-forming element. The element is effectively used to stabilize the metallurgical structure and to form martensite by the quenching treatment. Regarding the latter, the Mn content of less than 0.05% provides a very small effect whereas the Mn content of more than 1.5% provides a saturated effect. Hence, it is desirable that the Mn content is set to be 0.05 to 1.5%. The range of the content should be preferably 0.1 to 1.0% and more preferably 0.1 to 0.8%.

P: Not More Than 0.03%

P is an impurity element and provides an very harmful influence on the toughness of the steel, and at the same time reduces the corrosion resistance in the corrosion environment containing $CO_2$ and others. A smaller P content is correspondingly more desirable. However, there is no special problem at a P content of 0.03% or less. Accordingly, the P content should be preferably not more than 0.02%, and more preferably not more than 0.015%.

S: Not More Than 0.01%

S is an impurity element, in the same way as P, and provides a very harmful influence on the hot workability of the steel. Therefore, a smaller content of S is correspondingly more desirable. However, there is no special problem at a S content of 0.01% or less. Accordingly, the S content should be preferably not more than 0.005% and more preferably not more than 0.003%.

Ni: 0.1 to 7.0%

Ni is an austenite-forming element, and has an effect to stabilize the metallurgical structure and to form martensite by the quenching treatment. Moreover, Ni plays an essential role for ensuring to maintain the corrosion resistance, the stress corrosion cracking resistance and the like in a severe corrosion environment containing $CO_2$, Cl—, $H_2S$ and the like. A Ni content of not less than 0.1% is required to obtain the above-mentioned effects. When, however, the content becomes more than 7.0%, the production cost significantly increases. Accordingly, it is desirable that the Ni content ranges from 0.1 to 7.0%. The range should be preferably 0.1 to 3.0% and more preferably 0.1 to 2.0%.

Al: 0.0005 to 0.05%

Al serves as an element effective for deoxidizing. For this purpose, an Al content of not less than 0.0005% is required. On the other hand, an Al content of more than 0.05% reduces the toughness. Accordingly, it is desirable that the Al content ranges from 0.0005 to 0.05%. The range should be preferably 0.005 to 0.03%, and more preferably 0.01 to 0.02%.

In addition, (an) element(s) in at least one of group A, group B and group C, which are described below, can be included in the above-mentioned preferable martensitic stainless steels:

Group A: At Least One of Mo and Cu

These elements improve the corrosion resistance in the corrosion environment containing $H_2S$, $CO_2$ and Cl—, and a marked effect can be obtained at the Mo or Cu content of not less than 0.05%. However, either a Mo content of more than 5% or a Cu content of more than 3% provides not only saturation on the above effects, but also a reduction in the toughness at the area suffered by the heat effect due to welding. It is therefore desirable that the Mo content and the Cu content are set to be 0.05 to 5% and 0.05 to 3%, respectively. The range for Mo should be preferably 0.1 to 2%, and more preferably 0.1 to 0.5% whereas the range for Cu should be preferably 0.05 to 2.0% and more preferably 0.05 to 1.5%.

Group B: At Least One of Ti, V and Nb

Each of these elements improves the stress corrosion crack resistance in the corrosion environment containing $H_2S$, and, at the same time, increases the tensile strength at a high temperature. A content of not less than 0.005% for each element provides a prominent effect on the above properties. However, a content of more than 0.5% for each element causes the toughness to deteriorate. It is therefore desirable that the content of each element ranges from 0.005 to 0.5%. The range should be preferably 0.005 to 0.2%, and more preferably 0.005 to 0.05%.

Group C: At Least One of B, Ca, Mg and Rare-Earth Elements

Each of these elements improves the hot workability, and a prominent effect can be obtained at a content of not less than 0.0002% for B, or at a content of not less than 0.0003% for Ca, Mg or a rare-earth element. However, a content of more than 0.005% for each element provides a reduction not only in the toughness, but also in the corrosion resistance under the corrosion environment containing $CO_2$ and the like. Therefore, it is desirable that the content is 0.0002 to 0.005% for B, 0.0003 to 0.005% for Ca, Mg or a rare-earth element. The range for any element should be preferably 0.0005 to 0.0030%, and more preferably 0.0005 to 0.0020%.

EXAMPLES

Five kinds of steel blocks (thickness 70 mm and width 120 mm) having a chemical composition, as shown in Table 1 were prepared. The steels having such a chemical composition were molten in a vacuum-melting furnace having a capacity of 150 kg. The respective ingots obtained were heated for 2 hours at 1,250° C. and then forged into a predetermined shape.

Example 1

Each block was heated for one hour at 1,250° C., and then hot-rolled to form a steel plate having a thickness of 7 to 50 mm. In this case, two type steel plates, one satisfying and the other unsatisfying the above condition a, were prepared by varying both the finishing temperature in the hot rolling and the heat treatment conditions. Applying a tensile test, a Charpy impact test and a corrosion test to these steel plates, the tensile properties (yield strength: YS (MPa) and tensile strength: TS (MPa)), the impact property (fracture appearance transition temperature: vTrs (° C.)) and the corrosion property were investigated.

The tensile test was carried out using 4 mm diameter rod specimens machined from the respective steel plates after the heat treatment.

TABLE 1

| Steel type symbols | Chemical composition (units: mass %, residual: Fe and impurities) | | | | | | | | | | | | | | | |
|---|---|---|---|---|---|---|---|---|---|---|---|---|---|---|---|---|
| | C | Si | Mn | P | S | Cu | Cr | Ni | Mo | Ti | V | Nb | Al | B | N | Ca |
| A | 0.03 | 0.25 | 0.52 | 0.013 | 0.0009 | 1.0 | 10.8 | 1.2 | 0.2 | — | 0.04 | — | 0.004 | — | 0.027 | 0.0011 |
| B | 0.05 | 0.28 | 0.43 | 0.005 | 0.0008 | 1.5 | 10.7 | 1.4 | 0.8 | — | 0.05 | — | 0.025 | — | 0.031 | 0.0008 |
| C | 0.07 | 0.38 | 0.39 | 0.009 | 0.0009 | 0.8 | 11.1 | 0.7 | 0.3 | 0.07 | 0.04 | — | 0.002 | — | 0.004 | 0.0007 |
| D | 0.08 | 0.18 | 0.87 | 0.013 | 0.0013 | — | 12.2 | 1.3 | 0.1 | — | 0.05 | — | 0.015 | — | 0.016 | 0.0009 |
| E | 0.04 | 0.22 | 0.66 | 0.016 | 0.0011 | — | 11.6 | 1.7 | — | 0.10 | 0.04 | 0.021 | 0.001 | 0.0010 | 0.051 | — |

The Charpy impact test was carried out using 2 mm V-shaped notch test pieces having a sub-size of 5 mm×10 mm×55 mm, which were machined from the respective steel plates after the heat treatment.

The corrosion test was carried out by immersing coupon test pieces having a size of 2 mm×10 mm×25 mm into 5 mass % NaCl solution saturated with 0.003 atm $H_2S$ (0.0003 MPa $H_2S$)—30 atm $CO_2$ (3 MPa CO2) for 720 hours, said test pieces being machined from the respective steel plates after the heat treatment. In the evaluation of the corrosion resistance, test pieces exhibiting a corrosion speed of not more than 0.05 g/m$^2$/hr and those exhibiting a corrosion speed of more than 0.05 g/m$^2$/hr are classified as a good ones (○) and bad ones (x), respectively.

The obtained results are listed in Table 2, together with the finishing temperatures in the hot rolling, the heat treatments and the maximum lengths of the carbides in the direction of the minor axis, which were determined by the above-mentioned method.

TABLE 2

| Test piece No. | Steel type symbols | Finishing temperature in hot rolling (° C.) | Treatments after hot rolling (heat treatments) | Plate thickness (mm) | Maximum length of carbide in the direction of the minor axis (nm) | Tensile properties YS (MPa) | Tensile properties TS (MPa) | Impact property vTrs (° C.) | Corrosion resistance |
|---|---|---|---|---|---|---|---|---|---|
| 1 | A | 1,010 | AC + 920° C. × 15 min WQ + 350° C. × 30 min AC | 50 | 33 | 808 | 1,053 | −51 | ○ |
| 2 | A | 1,020 | AC + 920° C. × 15 min AC + 650° C. × 30 min AC | 50 | *350 | 727 | 979 | −9 | X |
| 3 | B | 950 | WQ + 930° C. × 15 min WQ + 420° C. × 30 min AC | 25 | 50 | 852 | 1,078 | −50 | ○ |
| 4 | B | 940 | AC + 930° C. × 15 min AC + 650° C. × 30 min AC | 25 | *420 | 810 | 1,037 | −6 | X |
| 5 | C | 990 | AC + 950° C. × 15 min WQ + 380° C. × 30 min AC | 18 | 42 | 984 | 1,193 | −60 | ○ |
| 6 | C | 980 | AC + 950° C. × 15 min AC + 650° C. × 30 min AC | 18 | *520 | 950 | 1,155 | 18 | X |
| 7 | D | 930 | AC + 980° C. × 15 min WQ + 360° C. × 30 min AC | 10 | 38 | 985 | 1,208 | −61 | ○ |
| 8 | D | 930 | AC + 980° C. × 15 min AC + 650° C. × 30 min AC | 10 | *340 | 942 | 1,159 | 28 | X |
| 9 | E | 890 | AC + 920° C. × 15 min WQ + 400° C. × 30 min AC | 7 | 45 | 791 | 1,074 | −53 | ○ |

TABLE 2-continued

| Test piece No. | Steel type symbols | Finishing temperature in hot rolling (° C.) | Treatments after hot rolling (heat treatments) | Plate thickness (mm) | Maximum length of carbide in the direction of the minor axis (nm) | Tensile properties YS (MPa) | Tensile properties TS (MPa) | Impact property vTrs (° C.) | Corrosion resistance |
|---|---|---|---|---|---|---|---|---|---|
| 10 | E | 870 | AC + 920° C. × 15 min AC + 650° C. × 30 min AC | 7 | *310 | 765 | 1,003 | −8 | X |

Notes:
1) AC means air cooling (cooling at room temperature) and WQ means water quenching.
2) Mark * indicates the outside of the range specified by the present invention.

As can be dearly seen in Table 2, the steel plates corresponding to the test piece Nos. 1, 3, 5, 7 and 9, in which the microstructure satisfies the condition a specified by the present invention, are excellent regarding the toughness and the corrosion resistance with the high strength. On the contrary, the steel plates corresponding to the test piece Nos. 2, 4, 6, 8 and 10, in which the microstructure does not satisfy the condition a specified by the present invention, but the chemical composition satisfies the condition specified by the present invention, are unsatisfactory regarding the toughness and the corrosion resistance, although a high strength can be obtained.

Example 2

Each block was heated for one hour at 1,250° C., and then hot-rolled to form a steel plate having a thickness of 8 to 25 mm. In this case, two type steel plates, one satisfying and the other unsatisfying the above condition b, were prepared by varying both the finishing temperature in the hot rolling and the heat treatment conditions. Applying a tensile test, a Charpy impact test and a corrosion test to these steel plates, the tensile properties (yield strength: YS (MPa) and tensile strength: TS (MPa)), the impact property (fracture appearance transition temperature: vTrs (° C.)) and the corrosion property were investigated.

In this case, the tensile test, the Charpy impact test and the corrosion test and the evaluation thereof were the same as those in the case of Example 1.

The obtained results are listed in Table 3, together with the finishing temperatures in the hot rolling, the heat treatments and the ratios of the average Cr concentration to the average Fe concentration in the carbides, which were determined by the above-mentioned method.

TABLE 3

| Test piece No. | Steel type symbols | Finishing temperature in hot rolling (° C.) | Treatments after hot rolling (heat treatments) | Plate thickness (mm) | Average Cr concentration/average Fe concentration in carbide | Tensile properties YS (MPa) | Tensile properties TS (MPa) | Impact property vTrs (° C.) | Corrosion resistance |
|---|---|---|---|---|---|---|---|---|---|
| 11 | A | 900 | AC + 280° C. × 30 min AC | 12 | 0.11 | 843 | 1,063 | −83 | ○ |
| 12 | A | 900 | AC + 910° C. × 15 min AC + 650° C. × 30 min AC | 12 | *0.58 | 729 | 979 | −13 | X |
| 13 | B | 950 | AC + 320° C. × 30 min AC | 25 | 0.13 | 867 | 1,088 | −81 | ○ |
| 14 | B | 960 | AC + 940° C. × 15 min AC + 650° C. × 30 min AC | 25 | *0.65 | 820 | 1,035 | 3 | X |
| 15 | C | 920 | AC + 280° C. × 30 min AC | 12 | 0.10 | 988 | 1,183 | −78 | ○ |
| 16 | C | 920 | AC + 960° C. × 15 min AC + 650° C. × 30 min AC | 12 | *0.82 | 949 | 1,141 | 15 | X |
| 17 | D | 800 | AC + 1,030° C. × 15 min AC | 8 | 0.11 | 1,002 | 1,228 | −92 | ○ |
| 18 | D | 800 | AC + 1,020° C. × 15 min AC + 650° C. × 30 min AC | 8 | *0.79 | 951 | 1,158 | 22 | X |
| 19 | E | 800 | AC | 20 | 0.11 | 783 | 1,065 | −91 | ○ |

TABLE 3-continued

| Test piece No. | Steel type symbols | Finishing temperature in hot rolling (° C.) | Treatments after hot rolling (heat treatments) | Plate thickness (mm) | Average Cr concentration/ average Fe concentration in carbide | Tensile properties YS (MPa) | Tensile properties TS (MPa) | Impact property vTrs (° C.) | Corrosion resistance |
|---|---|---|---|---|---|---|---|---|---|
| 20 | E | 990 | AC + 950° C. × 15 min AC + 650° C. × 30 min AC | 20 | *0.68 | 757 | 1,001 | −5 | X |

Notes:
1) AC means air cooling (cooling at room temperature).
2) Mark * indicates the outside of the range specified by the present invention.

As can be clearly seen in Table 3, the steel plates corresponding to the test piece Nos. 11, 13, 15, 17 and 19, in which the microstructure satisfy the condition b specified by the present invention, are excellent regarding the toughness and the corrosion resistance with the high strength. On the contrary, the steel plates corresponding to the test piece Nos. 12, 14, 16, 18 and 20, in which the microstructure does not satisfy the condition b specified by the present invention, but the chemical composition satisfies the condition specified by the present invention, are unsatisfactory regarding the toughness and the corrosion resistance, although a high strength can be obtained.

Example 3

Each block was heated for one hour at 1,250° C., and then hot-rolled to form a steel plate having a thickness of 14 to 25 mm. In this case, two type steel plates, one satisfying and the other unsatisfying the above condition c, were prepared by varying both the finishing temperature in the hot rolling and the heat treatment conditions. Applying a tensile test, a Charpy impact test and a corrosion test to these steel plates, the tensile properties (yield strength: YS (MPa) and tensile strength: TS (MPa)), the impact property (fracture appearance transition temperature: vTrs (° C.)) and the corrosion property were investigated.

In this case, the tensile test, the Charpy impact test and the corrosion test and the evaluation thereof were the same as those in the case of Example 1.

The obtained results are listed in Table 4, together with the finishing temperatures in the hot rolling, the heat treatments and the contents of $M_{23}C_6$ type carbides, $M_3C$ type carbides and MN type or $M_2N$ type nitrides, which were determined by the above-mentioned method.

TABLE 4

| Test piece No. | Steel type symbols | Finishing temperature in hot rolling (° C.) | Treatments after hot rolling (heat treatments) | Plate thickness (mm) | Content of $M_{23}C_6$ type carbides (vol. %) | Content of $M_3C$ type carbides (vol. %) | Content of MN type or $M_2N$ type nitrides (vol. %) | Tensile properties YS (MPa) | Tensile properties TS (MPa) | Impact property vTrs (° C.) | Corrosion resistance |
|---|---|---|---|---|---|---|---|---|---|---|---|
| 21 | A | 990 | AC + 900° C. × 15 min AC | 20 | 0 | 0.08 | 0 | 825 | 1,057 | −81 | ○ |
| 22 | A | 1,000 | AC + 910° C. × 15 min AC + 650° C. × 30 min AC | 20 | 0.6 | *0 | 0.21 | 742 | 967 | −3 | X |
| 23 | B | 1,000 | AC + 960° C. × 15 min AC | 25 | 0 | 0.12 | 0 | 853 | 1,073 | −96 | ○ |
| 24 | B | 1,020 | AC + 940° C. × 15 min AC + 650° C. × 30 min AC | 25 | 0.8 | *0 | 0.22 | 817 | 1,024 | 2 | X |
| 25 | C | 900 | AC + 980° C. × 15 min AC | 14 | 0 | 0.18 | 0 | 988 | 1,188 | −92 | ○ |
| 26 | C | 890 | AC + 970° C. × 15 min AC + 650° C. × 30 min AC | 14 | *1.2 | *0 | 0.03 | 948 | 1,151 | 20 | X |
| 27 | D | 1,000 | AC | 22 | 0 | 0.45 | 0 | 989 | 1,219 | −98 | ○ |
| 28 | D | 1,020 | AC + 1,030° C. × 15 min AC + 650° C. × 30 min AC | 22 | *1.4 | *0 | 0.09 | 946 | 1,154 | 26 | X |
| 29 | E | 940 | AC + 300° C. × 30 min AC | 15 | 0 | 0.11 | 0 | 795 | 1,069 | −78 | ○ |
| 30 | E | 950 | AC + 900° C. × 15 min AC + 650° C. × 30 min AC | 15 | 0 | *0 | *0.34 | 758 | 993 | −6 | X |

Notes:
1) AC means air cooling (cooling at room temperature).
2) Mark * indicates the outside of the range specified by the present invention.

As can be dearly seen in Table 4, the steel plates corresponding to the test piece Nos. 21, 23, 25, 27 and 29, in which the microstructure satisfy the condition c specified by the present invention, are excellent regarding the toughness and the corrosion resistance with the high strength. On the contrary, the steel plates corresponding to the test piece Nos. 22, 24, 26, 28 and 30, in which the microstructure does not satisfy the condition c specified by the present invention, but the chemical composition satisfies the condition specified by the present invention, are unsatisfactory regarding the toughness and the corrosion resistance, although a high strength can be obtained.

INDUSTRIAL APPLICABILITY

The martensitic stainless steel according to the present invention provides excellent properties regarding the toughness and the corrosion resistance, in spite of both a relatively high carbon content and a high strength, and therefore it can be used effectively as a pipe material for oil wells, in particular for oil wells having a much greater depth. The reduction of the carbon content as required in the improved 13% Cr steels is no longer necessary. This causes to reduce the content of Ni which is expensive, so that the production cost can also be reduced. A wide applicability can be expected to pipe material for oil wells containing carbon dioxide and a small amount of hydrogen sulfide, in particular for oil wells having a much greater depth.

What is claimed is:

1. A stainless steel having a microstructure of martensite, a yield strength of 759 MPa or higher and a brittle-to-ductile fracture transition temperature vTrs lower than −30° C., and consisting essentially of a C content of 0.02 to 0.1 mass %, a Si content of 0.05 to 1 mass %, a Mn content of 0.05 to 1.5 mass %, a P content of not more than 0.03 mass %, a S content of not more than 0.01 mass %, a Cr content of 9 to 15 mass %, a Ni content of 0.1 to 7.0 mass %, a N content of not more than 0.1 mass % an Al content of 0.0005 to 0.05 mass %, and at least one of Ti, V and Nb at a content of 0.005 to 0.5 mass %, at a content of 0.005 to 0.5 mass % and at a content of 0.005 to 0.5 mass %, respectively, the residual being Fe and impurities, and said microstructure of martensite contains carbides wherein the maximum length of $M_3C$ carbides in the steel is 10 to 200 nm in the direction of the minor axis.

2. The stainless steel according to claim 1, wherein in place of part of Fe, the stainless steel includes at least one of Mo and Cu at a content of 0.05 to 5 mass % and at a content of 0.05 to 3 mass %, respectively.

3. The stainless steel according to claim 1, wherein in place of part of Fe, the stainless steel includes at least one of B, Ca, Mg and rare-earth elements at a content of 0.0002 to 0.005 mass %, at a content of 0.0003 to 0.005 mass %, at a content of 0.0003 to 0.005 mass % and at a content of 0.0003 to 0.005 mass %, respectively.

4. A stainless steel having a microstructure of martensite, a yield strength of 759 MPa or higher and a brittle-to-ductile fracture transition temperature vTrs lower than −30° C., and consisting essentially of a C content of 0.02 to 0.1 mass %, a Si content of 0.05 to 1mass %, a Mn content of 0.05 to 1.5 mass %, a P content of not more than 0.03 mass %, a S content of not more than 0.01 mass %, a Cr content of 9 to 15 mass %, a Ni content of 0.1 to 7.0 mass %, a N content of not more than 0.1 mass %, an Al content of 0.0005 to 0.05 mass %, and at least one of Ti. V and Nb at a content of 0.005 to 0.5 mass %. at a content of 0.005 to 0.5 mass % and at a content of 0.005 to 0.5 mass %. respectively, the residual being Fe and impurities, and said microstructure of martensite contains carbides wherein the ratio of the average Cr concentration [Cr] to the average Fe concentration [Fe] in carbides in the steel ([Cr]/[Fe]) is not more than 0.4.

5. The stainless steel according to claim 4, wherein in place of part of Fe, the stainless steel includes at least one of Mo and Cu at a content of 0.05 to 5 mass % and at a content of 0.05 to 3 mass %, respectively.

6. The stainless steel according to claim 4, wherein in place of part of Fe, the stainless steel includes at least one of B, Ca, Mg and rare-earth elements at a content of 0.0002 to 0.005 mass %, at a content of 0.0003 to 0.005 mass %, at a content of 0.0003 to 0.005 mass % and at a content of 0.0003 to 0.005 mass %, respectively.

7. A martensitic stainless steel having a microstructure of martensite, a yield strength of 759 MPa or higher and a brittle-to-ductile fracture transition temperature vTrs lower than −30° C., and consisting essentially of a C content of 0.02 to 0.1 mass %, a Si content of 0.05 to 1 mass %, a Mn content of 0.05 to 1.5 mass %, a P content of not more than 0.03 mass %, a S content of not more than 0.01 mass %, a Cr content of 9 to 15 mass %, a Ni content of 0.1 to 7.0 mass %, a N content of not more than 0.1 mass %, an Al content of 0.0005 to 0.05 mass %, and at least one of Ti, V and Nb at a content of 0.005 to 0.5 mass %, at a content of 0.005 to 0.5 mass % and at a content of 0.005 to 0.5 mass %, respectively, the residual being Fe and impurities, and said microstructure of martensite contains carbides wherein the content of $M_{23}C_6$ carbides in the steel is not more than 1 volume %, the content of $M_3C$ carbides in the steel is 0.01 to 1.5 volume % and the content of MN or $M_2N$ nitrides in the steel is not more than 0.3 volume %.

8. The stainless steel according to claim 7, wherein in place of part of Fe, the stainless steel includes at least one of Mo and CU at a content of 0.05 to 5 mass % and at a content of 0.05 to 3 mass %, respectively.

9. The stainless steel according to claim 7, wherein in place of part of Fe, the stainless steel includes at least one of B, Ca, Mg and rare-earth elements at a content of 0.0002 to 0.005 mass %, at a content of 0.0003 to 0.005 mass %, at a content of 0.0003 to 0.005 mass % and at a content of 0.0003 to 0.005 mass %, respectively.

10. The stainless steel according to claim 2, wherein in place of part of Fe, the stainless steel includes at least one of B, Ca, Mg and rare-earth elements at a content of 0.0002 to 0.005 mass %, at a content of 0.0003 to 0.005 mass %, at a content of 0.0003 to 0.005 mass % and at a content of 0.0003 to 0.005 mass %, respectively.

11. The stainless steel according to claim 5, wherein in place of part of Fe, the stainless steel includes at least one of B, Ca, Mg and rare-earth elements at a content of 0.0002 to 0.005 mass %, at a content of 0.0003 to 0.005 mass %, at a content of 0.0003 to 0.005 mass % and at a content of 0.0003 to 0.005 mass %, respectively.

12. The stainless steel according to claim 8, wherein in place of part of Fe, the stainless steel includes at least one of B, Ca, Mg and rare-earth elements at a content of 0.0002 to 0.005 mass %, at a content of 0.0003 to 0.005 mass %, at a content of 0.0003 to 0.005 mass % and at a content of 0.0003 to 0.005 mass %, respectively.

* * * * *

UNITED STATES PATENT AND TRADEMARK OFFICE

CERTIFICATE OF CORRECTION

PATENT NO. : 7,361,236 B2
APPLICATION NO. : 10/411186
DATED : April 22, 2008
INVENTOR(S) : Kondo et al.

It is certified that error appears in the above-identified patent and that said Letters Patent is hereby corrected as shown below:

On the title page item (57), in the abstract, line 13:
"C content and a high strength, thereby providing a, wide:"
should read:
--C content and a high strength, thereby providing a wide--

Column 15, line 65:
"mass %, and at least one of Ti. V and Nb at a content of 0.005"
should read:
--mass %, and at least one of Ti, V and Nb at a content of 0.005--

Column 16, line 1:
"to 0.5 mass %. at a content of 0.005 to 0.5 mass % and at a"
should read:
--to 0.5 mass %, at a content of 0.005 to 0.5 mass % and at a--

Column 16, line 2:
"content of 0.005 to 0.5 mass %. respectively, the residual"
should read:
--content of 0.005 to 0.5 mass %, respectively, the residual--

Column 16, line 37:
"of Mo and CU at a content of 0.05 to 5 mass % and at a"
should read:
--of Mo and Cu at a content of 0.05 to 5 mass % and at a--

Signed and Sealed this

Fourth Day of November, 2008

JON W. DUDAS
*Director of the United States Patent and Trademark Office*